US007311224B2

(12) United States Patent
Emmendoerfer et al.

(10) Patent No.: US 7,311,224 B2
(45) Date of Patent: Dec. 25, 2007

(54) CHEMICAL DISPENSE SYSTEM FOR CLEANING COMPONENTS OF A FLUID DISPENSING SYSTEM

(75) Inventors: Joerg Emmendoerfer, Wuppertal (DE); Knut Richter, Freising (DE)

(73) Assignee: Ecolab Inc., St. Paul, MN (US)

( * ) Notice: Subject to any disclaimer, the term of this patent is extended or adjusted under 35 U.S.C. 154(b) by 581 days.

(21) Appl. No.: 10/985,302

(22) Filed: Nov. 9, 2004

(65) Prior Publication Data

US 2006/0097008 A1 May 11, 2006

(51) Int. Cl.
*B67D 5/56* (2006.01)

(52) U.S. Cl. ..... 222/129; 222/148; 137/240

(58) Field of Classification Search ..... 222/129, 222/148, 145.5, 135, 129.1, 190, 23; 137/240, 137/237, 238, 230, 242, 246, 246.11, 597, 137/512, 624.11, 624.12, 624.13
See application file for complete search history.

(56) References Cited

U.S. PATENT DOCUMENTS 2,098,525 A * 11/1937 Smith ..... 134/93
2,178,559 A * 11/1939 Abraham et al. ..... 137/207.5
2,556,003 A 6/1951 Sandell et al.
2,583,982 A * 1/1952 Zwosta et al. ..... 15/302
2,749,930 A 6/1956 Whitnall
3,596,809 A 8/1971 Taubenbeim
3,596,810 A 8/1971 Taubenbeim
3,878,970 A 4/1975 Nezworski
4,273,151 A 6/1981 Nezworski
4,350,270 A 9/1982 Nezworski
4,350,273 A 9/1982 Nezworski et al.
4,351,456 A 9/1982 Nezworski
4,527,585 A 7/1985 Mirabile (Continued)

FOREIGN PATENT DOCUMENTS

DE 43 29 784 A1 3/1995

(Continued)

OTHER PUBLICATIONS

International Search Report and Written Opinion, from corresponding PCT Application Serial No. PCT/US2005/039247, mailed Sep. 25, 2006, 16 pages.

(Continued)

*Primary Examiner*—Lien M. Ngo
(74) *Attorney, Agent, or Firm*—Shumaker & Sieffert, P.A.

(57) ABSTRACT

A system and method for cleaning the beverage-carrying components of a beverage dispensing system in order to clean these components for future use is disclosed. The cleaning system includes a controller, a plurality of junctions, a plurality of couplers and a multiplier. The controller controls the different phases of the cleaning process, which include a beverage conservation phase, a beverage lockout phase and a cleaning phase. Each of the plurality of junctions are fluidly connected to at least one coupler and each coupler is affixed to a beverage container, e.g., keg, for opening a beverage port thereto. The multiplier is communicatively coupled to each junction so as to provide electrical control signals thereto that dictate whether fluid is to communicated through a junction to the coupler(s) associated with that junction, and thereafter directed to dispensing unit(s) over beverage line(s).

20 Claims, 9 Drawing Sheets

U.S. PATENT DOCUMENTS

| | | | | |
|---|---|---|---|---|
| 4,572,230 | A | | 2/1986 | Mirabile |
| 4,582,226 | A | * | 4/1986 | Doak ..... 222/148 |
| 4,685,598 | A | | 8/1987 | Nezworski |
| 4,941,593 | A | | 7/1990 | Hicks et al. |
| 4,977,910 | A | | 12/1990 | Miyahara et al. |
| 5,090,440 | A | | 2/1992 | Ladouceur et al. |
| 5,095,572 | A | | 3/1992 | Wagner |
| 5,343,907 | A | | 9/1994 | Wagner |
| 5,367,838 | A | | 11/1994 | Visaisouk et al. |
| 5,601,127 | A | | 2/1997 | Hanson |
| 5,636,763 | A | | 6/1997 | Furness |
| 5,718,161 | A | | 2/1998 | Beadle |
| 5,762,096 | A | | 6/1998 | Mirabile |
| 5,785,581 | A | | 7/1998 | Settles |
| 5,820,447 | A | | 10/1998 | Niechcial |
| 5,823,222 | A | | 10/1998 | Minshull et al. |
| 5,910,042 | A | | 6/1999 | Niechcial |
| 6,001,000 | A | | 12/1999 | Visaisouk et al. |
| 6,223,948 | B1 | | 5/2001 | Davis |
| 6,223,955 | B1 | | 5/2001 | Till |
| 6,270,394 | B1 | | 8/2001 | Visaisouk et al. |
| 6,287,515 | B1 | | 9/2001 | Koosman et al. |
| 6,305,441 | B1 | | 10/2001 | Till |
| 6,315,172 | B1 | | 11/2001 | Till |
| 6,382,467 | B2 | | 5/2002 | Saveliev et al. |
| 6,485,577 | B1 | | 11/2002 | Kiholm |
| 6,510,857 | B1 | | 1/2003 | Middleton |
| 6,530,501 | B2 | | 3/2003 | Till |
| 6,601,603 | B2 | | 8/2003 | Griffin |
| 6,817,366 | B1 | | 11/2004 | Weiss |
| 6,916,383 | B2 | | 7/2005 | Quarini |
| 2003/0070446 | A1 | | 4/2003 | Scullion et al. |
| 2003/0161925 | A1 | | 8/2003 | Scullion et al. |
| 2003/0161931 | A1 | | 8/2003 | Scullion et al. |
| 2003/0183249 | A1 | | 10/2003 | Nissinen et al. |
| 2003/0232736 | A1 | | 12/2003 | Renfrow |
| 2004/0004007 | A1 | | 1/2004 | Orolin et al. |
| 2004/0129016 | A1 | | 7/2004 | Anderson et al. |
| 2004/0245281 | A1 | | 12/2004 | Oke |
| 2005/0107006 | A1 | | 5/2005 | Makino et al. |
| 2005/0142268 | A1 | | 6/2005 | Scullion et al. |
| 2005/0142269 | A1 | | 6/2005 | Scullion et al |

FOREIGN PATENT DOCUMENTS

| | | | |
|---|---|---|---|
| DE | 297 04 794 | U1 | 4/1997 |
| EP | 0 194 121 | B1 | 7/1990 |
| EP | 0 409 305 | A2 | 1/1991 |
| EP | 0 409 305 | A3 | 1/1991 |
| EP | 0 409 305 | B1 | 1/1991 |
| EP | 0 528 414 | B1 | 2/1993 |
| EP | 0 363 768 | B1 | 3/1993 |
| EP | 0 409 305 | A2 | 9/1993 |
| EP | 0 409 305 | B1 | 9/1993 |
| EP | 0 759 409 | A1 | 2/1997 |
| EP | 0 852 971 | A1 | 7/1998 |
| EP | 1 013 349 | A1 | 6/2000 |
| EP | 0 987 214 | B1 | 3/2002 |
| EP | 1 228 812 | A2 | 8/2002 |
| EP | 1 228 815 | A2 | 8/2002 |
| EP | 1 078 038 | B1 | 7/2003 |
| EP | 1 404 464 | B1 | 12/2004 |
| GB | 1 348 654 | | 3/1974 |
| GB | 1 379 736 | | 1/1975 |
| GB | 2 297 296 | A | 9/1995 |
| GB | 2 289 262 | A | 11/1995 |
| GB | 2 297 598 | A | 8/1996 |
| GB | 2 353 348 | A | 2/2001 |
| GB | 2 353 349 | A | 2/2001 |
| GB | 2 353 350 | A | 2/2001 |
| GB | 2 353 587 | A | 2/2001 |
| GB | 2 358 229 | A | 7/2001 |
| GB | 2 362 741 | A | 11/2001 |
| GB | 2 367 611 | A | 4/2002 |
| GB | 2 368 114 | A | 4/2002 |
| GB | 2 374 915 | A | 10/2002 |
| GB | 2 397 111 | A | 7/2004 |
| GB | 2 397 117 | A | 7/2004 |
| GB | 2 397 118 | | 7/2004 |
| GB | 2 398 229 | | 8/2004 |
| GB | 2398156 | A | 11/2004 |
| JP | 05213394 | A | 8/1993 |
| JP | 8 53196 | | 2/1996 |
| JP | 08183598 | A | 7/1996 |
| JP | 11171298 | A | 6/1999 |
| JP | 2001 233398 | | 8/2001 |
| JP | 200230298 | A | 10/2002 |
| WO | WO 93/22235 | | 11/1993 |
| WO | WO 95/012543 | | 5/1995 |
| WO | WO 99/60092 | | 11/1999 |
| WO | WO 00/61715 | | 10/2000 |
| WO | WO 01/05526 | A1 | 1/2001 |
| WO | WO 01/30515 | A1 | 5/2001 |
| WO | WO 01/36582 | A1 | 5/2001 |
| WO | WO 01/94040 | A1 | 6/2001 |
| WO | WO 01/51224 | A1 | 7/2001 |
| WO | WO 01/51225 | A1 | 7/2001 |
| WO | WO 01/94040 | A1 | 12/2001 |
| WO | WO 03/040023 | A3 | 5/2003 |
| WO | WO 2004/000475 | A1 | 12/2003 |
| WO | 0403370 | | 3/2004 |
| WO | WO 2004/044339 | A2 | 5/2004 |
| WO | WO 2005/016814 | A1 | 2/2005 |

OTHER PUBLICATIONS

Notification of Transmittal of the International Search Report and Written Opinion from PCT Application No. PCT/US2006/042615, mailed Jun. 18, 2007, (22 pages).

* cited by examiner

CHEMICAL DISPENSE SYSTEM FOR CLEANING COMPONENTS OF A FLUID DISPENSING SYSTEM

TECHNICAL FIELD

The invention relates generally to a chemical dispense system, and more particularly to a cleaning components of a fluid dispensing system utilizing the chemical dispense system.

BACKGROUND

It is generally understood that fluid dispensing systems having fluid lines that carry fluids to a point of use need cleaning from time to time in order to ensure that no soil deposits or micro organisms collect in the fluid lines. For example, beverage distribution systems employ the use of beverage lines to carry beverages from beverage containers, or tanks, to dispensing units, which dispense the beverages to drinking containers. If for some reason, these beverage lines are not cleaned on a regular basis, the collection of bacteria and soil therein may contaminate the beverages thereby making the beverages unsafe to drink. Moreover, in commercial restaurant settings, food and health regulations actually require the cleaning of beverage dispensing systems periodically.

It is well known to use portable chemical dispense systems to clean out beverage lines and other components of beverage dispensing systems. With these portable systems, users have become quite effective in meeting the various requirements imposed by food and health regulations. However, these prior art methods are extremely time consuming and require the attention of at least one person to manually move the chemical dispense systems between each of the various beverage lines that require cleaning in a particular beverage dispense system. To add to the frustration, more and more restaurants are offering a larger variety of beverages than offered in years past, thereby making an extremely time demanding process even more demanding.

It is against this background that the present invention has been made.

SUMMARY OF THE INVENTION

The present invention is generally directed to the integration of a chemical dispense system into a beverage dispensing system for cleaning. The chemical dispense system includes a dispensing control system having a controller, a plurality of gas-fluid junctions and a multiplier. The dispensing control system provides fluids to each of the plurality of gas-fluid junctions. Each gas-fluid junction serves as a regulator for enabling the flow of fluids between the dispensing control system and a plurality of couplers affixed to beverage ports on beverage containers in the beverage dispensing system. The multiplier provides control over the gas-fluid junctions by providing a control signal to activate specific gas-fluid junctions based on user instruction. In response to receiving a control signal from the multiplier, a gas-fluid junction distributes any fluids supplied by the dispensing control system to each of the plurality of couplers fluidly connected thereto. Each coupler directs the flow of fluid to a beverage line, which is connected to a dispensing unit.

In accordance with another embodiment, present invention provides a multi-phase cleaning process having a beverage conservation phase during which a beverage remaining in a beverage line is dispensed for use prior to cleaning the line. During this phase, the dispensing control system controls at least one coupler affixed to a beverage container containing the beverage such that fluids are precluded from entering or exiting the beverage container thereby directing any fluids supplied by the dispensing control system to the beverage line. The dispensing control system then supplies water to the coupler thereby creating a pressure and forcing any beverage remaining in the beverage line to an associated dispensing unit. As the beverage in the beverage line is dispensed through the dispensing unit, the dispensing control system supplies more water to the coupler. This process is repeated until all of the beverage remaining in the beverage line has been dispensed out of the dispensing unit by virtue of the dispensing control system increasing the supply of water to the coupler.

In accordance with yet another embodiment, present invention provides a multi-phase cleaning process having the beverage conservation phase, a beverage lockout phase and a cleaning phase. In this embodiment, a user is provided with the ability to customize a cleaning process based on his or her likings. Therefore, user interaction is involved to select which one or more of the phases of the cleaning process will be administered. First, the beverage conservation phase is administered if the user selects activation of the dispensing control system using a switch and within a predetermined time period de-activates the switch. Next, the beverage lockout phase is administered if the user waits for the beverage conservation phase to complete (if administered) and thereafter activates the switch, and within another predetermined period in time, de-activates the switch. If the beverage conservation phase is not administered, the user may still enter the beverage lockout phase by skipping the predetermined time in which to de-activate the switch to initiate administration of the beverage conservation phase, and then de-activating the switch within a next predetermined period in time. Otherwise, if the user takes no action the dispensing control system will proceed with the cleaning process in which water is first provided to flush out any remaining beverage in the beverage lines and then a chemical solution is applied thereto for cleaning purposes.

These and various other features as well as advantages, which characterize the present invention, will be apparent from a reading of the following detailed description and a review of the associated drawings.

DETAILED DESCRIPTION

Figure 1:
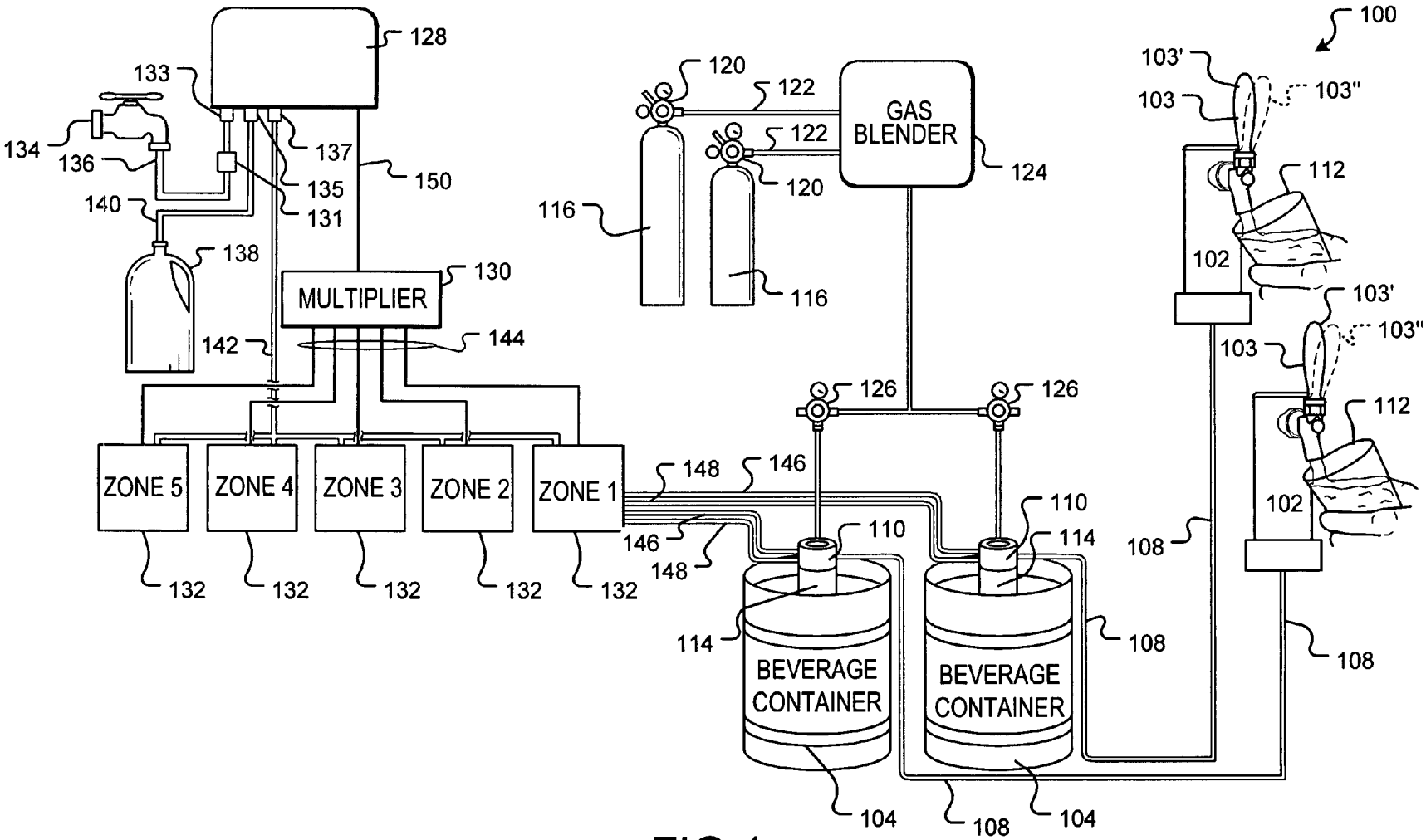
FIG. 1 illustrates components of a fluid dispensing system including a controller-based chemical dispense system for cleaning the components of the fluid dispensing system in accordance with an embodiment of the present invention.

The present invention and its various embodiments are described in detail below with reference to the figures. When referring to the figures, like structures and elements shown throughout are indicated with like reference numerals. Objects depicted in the figures that are covered by another object, as well as the reference annotations thereto, are shown using dashed lines.

In general, the present invention relates to a system for cleaning the various fluid-carrying components of a fluid dispensing system. These components include, without limitation, pipes (also referred to herein as "lines"), dispensing units, couplers, manifolds, junctions and valves. The cleaning system is chemical dispensing system that dispenses a chemical solution formed as a combination of water and a cleaning product. The chemical solution is provided to the fluid dispensing system and supplied through the various fluid carrying components of the fluid dispensing system in order to clean these components for future use. In accordance with an embodiment of the present invention, the fluid dispensing system is hereinafter described as a beverage dispensing system for dispensing beverages. As such, these "fluid-carrying components" are referred to herein as "beverage-carrying components." It should be appreciated that the embodiments of the invention described and claimed below are applicable to clean fluid dispensing systems other than beverage dispensing systems.

Referring now to FIG. 1, a beverage dispensing system 100 is shown in accordance with an embodiment of the present invention. While many different types of beverages and beverage dispensing systems are contemplated within the scope of the present invention, the beverage dispensing system 100 is described as being a beer dispensing system used to dispense beer to a bar area of a restaurant. Indeed, the below description of the present invention and its associated environment as being applicable to beer dispensing is illustrative only, and consequently beverage dispensing system 100 may be operable to dispense any other type of beverage, such as, for example, soda juices, coffees and dairy products.

The beverage dispensing system 100 dispenses different labels of beer through individual dispensing units 102, as shown in FIG. 1 in the form of conventional beer taps. The dispensing units 102 include handles 103 that may be toggled between an off position 103' and an on position 103", which is shown using dashed lines. While the handles 103 are in the off position 103', the dispensing units 102 preclude the flow of beer therefrom. Conversely, while the handles 103 are in the on position 103", the dispensing units 102 enable the flow of beer therefrom and preferably to some form of drinking article, such as a stein or mug 112. To illustrate embodiments of the present invention, the dispensing units 102 are shown in FIG. 1 with the handles 103 in the on position 103".

Prior to being dispensed, the beverages are contained in beverage containers 104. The beverage containers 104 are illustrated in FIG. 1 as being conventional-sized kegs in accordance with an embodiment other present invention. However, any other type and size of beverage container from which a beverage may be supplied will suffice. Whereas the dispensing units 102 are preferably located in the bar area, the beverage containers 104 are preferably stored in a cooling room in order to direct and maintain the temperature of the beverages at a desired temperature.

Each dispensing unit 102 is fluidly connected to a beverage container 104 by a beverage line 108. As known to those skilled in the art of beverage dispensing, an optional glycol chiller (not shown), air cooling system (not shown) or the like may be used to further chill beverages transported between the beverage containers 104 and the dispensing units 102 if so desired. Furthermore, an optional beverage pump (not shown) may be provided within the beverage line 108 to assist in providing the beverage to the associated dispensing unit 102. Such an implementation is preferable when the distance between the beverage dispenser 104 and the dispensing unit 102 is a relatively great distance. The beverage pump is activated while the handle 103 of the associated dispensing unit 102 is in the on position 103". Conversely, when the handle 103 of the associated dispensing unit 102 is in the off position 103', the beverage pump is de-activated.

As shown in FIG. 1, there exists a 1:1 correlation between dispensing units 102 and beverage containers 104 in accordance with an embodiment of the present invention. As known to those skilled in the art, such an implementation is preferred in beer dispensing systems. Alternative embodiments, however, may be configured such that more than one beverage container 104 may provide beverages to one dispensing unit 102, or vice-versa.

Each beverage line 108 is connected to an associated beverage container 104 by a coupler 110. Each coupler 110 is affixed to a beverage port 114 on the associated beverage container 104 through which the beverage is output for direction by the coupler 110 to the associated beverage line 108. Each coupler 110 provides functionality for opening the beverage port 114 to which the coupler 110 is affixed and introducing a pressure into the associated beverage container 104 to force the beverage contained therein through the beverage port 114 and to the associated beverage line 108. The connection provided by the coupler 110 between the beverage port 114 and the beverage line 108 is preferably air tight, and thereby operable to force the beverage through the associated beverage line 108 and to the associated dispensing unit 102. Depending on the position of the dispensing unit 102, dispensing of the beverage from the unit 102 is either precluded (i.e., handle 103 in "off" position 103') or enabled (i.e., handle 103 in "on" position 103'").

The pressure used to force beverages from the beverage containers 104 to the dispensing units 102 via the beverage lines 108 is supplied to the couplers 110 from one or more pressure sources, e.g., 116 and 118. These pressure sources 116, 118 are shown in accordance with an embodiment as being compressed gas tanks having different reference numerals (i.e., 116 and 118) to differentiate between the different types of gas contained by each. Each gas tank 116 and 118 includes a primary regulator 120. The primary regulators 120 regulate the flow of gas from the gas tanks 116,118 to a gas blender 124 via gas lines 122. The gas blender 124 blends the gases from the gas tanks 116 and 118 and provides a mixed gas compound to secondary regulators 126. Each of the secondary regulators 126 regulate the flow of the mixed gas compound from the gas blender 124 to individual couplers 110, thereby providing the requisite pressure to force the beverages from the beverage containers 104 to the dispensing units 102. As such, there exists a 1:1 correlation between secondary regulators 126 and beverage containers 104. In accordance with alternatives embodiments, a single secondary regulator 126 may regulate the flow of the mixed gas compound to more than one beverage container 104.

As described generally above, the present invention relates to cleaning various components of a fluid dispensing system. With this concept in mind, FIG. 1 illustrates the integration of a cleaning system to the beverage dispensing system 100. The cleaning system encompasses a chemical dispensing control system 128, the couplers 110, a multiplier 130 and gas-fluid junctions 132, each of which are shown generally in block diagram form in FIG. 1. The chemical dispensing control system 128 is a controller-based system that manages the overall administration of cleaning processes applied to the beverage dispensing system 100. Operation of the controller 200 for the chemical dispensing control system 128 is described in greater detail in connection with FIG. 2.

The chemical dispensing control system 128 is powered by a power source (not shown), which may be any conventional power source known to those skilled in the art. The chemical dispensing control system 128 includes a first fluid input port 133 and a second fluid input port 135 through which water and chemical solutions, respectively, are input to the system 128. Water provided to the first fluid input port 133 is supplied by a potable water source 134 via a water input line 136. In an embodiment, a backflow prevention device 131 is positioned in the water input line 136 in order to preclude chemical solutions and contaminated water used during cleaning processes from backflowing into the potable water source 134.

Chemical solutions provided to the second fluid input port 134 are supplied by a solution container, such as a jug 138, via a solution input line 140. The chemical dispensing control system 128 also includes a fluid output port 137 through which the water and chemical solutions are dispensed out of the system by way of a fluid manifold 142. Those skilled in the art will appreciate that the chemical dispensing control system 128 includes pumps, regulators or the like for enabling the flow of water and chemical solution into the system 128 via the water input line 136 and the solution input line 140 and subsequently out of the system 128 via the fluid manifold 142.

Water and a chemical solution are provided by the dispensing control system 128 to the gas-fluid junctions 132 by way of the fluid manifold 142. The gas-fluid junctions 132, when activated as described below, distribute the water and chemical solution from the fluid manifold 142 to couplers 110 for distribution through the beverage lines 108, the dispensing units 102 and any other component through which beverages are dispensed. For illustration purposes, the gas-fluid junction 132 of zone 1 is shown as being connected to the beverage containers 104 by junction-coupler fluid lines 146 that carry the water and chemical solution from this gas-fluid junction 132 to the couplers 110 when the gas-fluid junction 132 is activated. As described in greater detail in FIGS. 2-4, the cleaning system also includes junction-coupler gas lines 148 that carry control gas from the gas-fluid junctions 132 to the associated couplers 110 in order to close the beverage ports 114 of the associated beverage containers 104 such that the water and chemical solution dispensed during cleaning processes are not introduced thereto.

In accordance with an embodiment, each gas-fluid junction 132 serves a plurality of couplers 110, and in particular is described herein for illustration purposes as serving five (5) couplers 110 each. While it should be appreciated that a gas-fluid junction 132 may serve more or less than five couplers 110, the number of couplers 110 that a gas-fluid junction 132 may serve is indeed limited. For nomenclature purposes, a gas-fluid junction 132 and the set of couplers 110 served by that gas-fluid junction 132 is referred to herein as being in the same "zone." To illustrate this concept, FIG. 1 shows five (5) gas-fluid junctions 132, each identified by a particular zone number (e.g., "zone 1," "zone 2," etc.).

Because of the limitations on the number of couplers 110 that may be served by a single gas-fluid junction 132, the cleaning system includes the multiplier 130. The multiplier 130 is powered by a power source (not shown), which may be any conventional power source known to those skilled in the art. The multiplier 130 is communicatively connected to each gas-fluid junction 132 by a low voltage line 144. By supplying a control current to a gas-fluid junction 132 over a low voltage line 144, the multiplier 130 activates that gas-fluid junction 132, thereby initiating a cleaning process for all components of the beverage dispensing system 100 (e.g., beverage lines 108, dispensing units 102, etc.) fluidly connected to the couplers 110 served by that gas-fluid junction 132. As such, the multiplier 130 controls which gas-fluid junctions 132 are active thereby dictating the zone or zones to which a cleaning process is applied. Hence, the multiplier may also be referred to herein as a "zone controller." The multiplier 130 is also communicatively coupled to the dispensing control system 128 by a communication line 150 such that the dispensing control system 128 may monitor and control operation of the multiplier 130, as described in more detail below.

Figure 2:
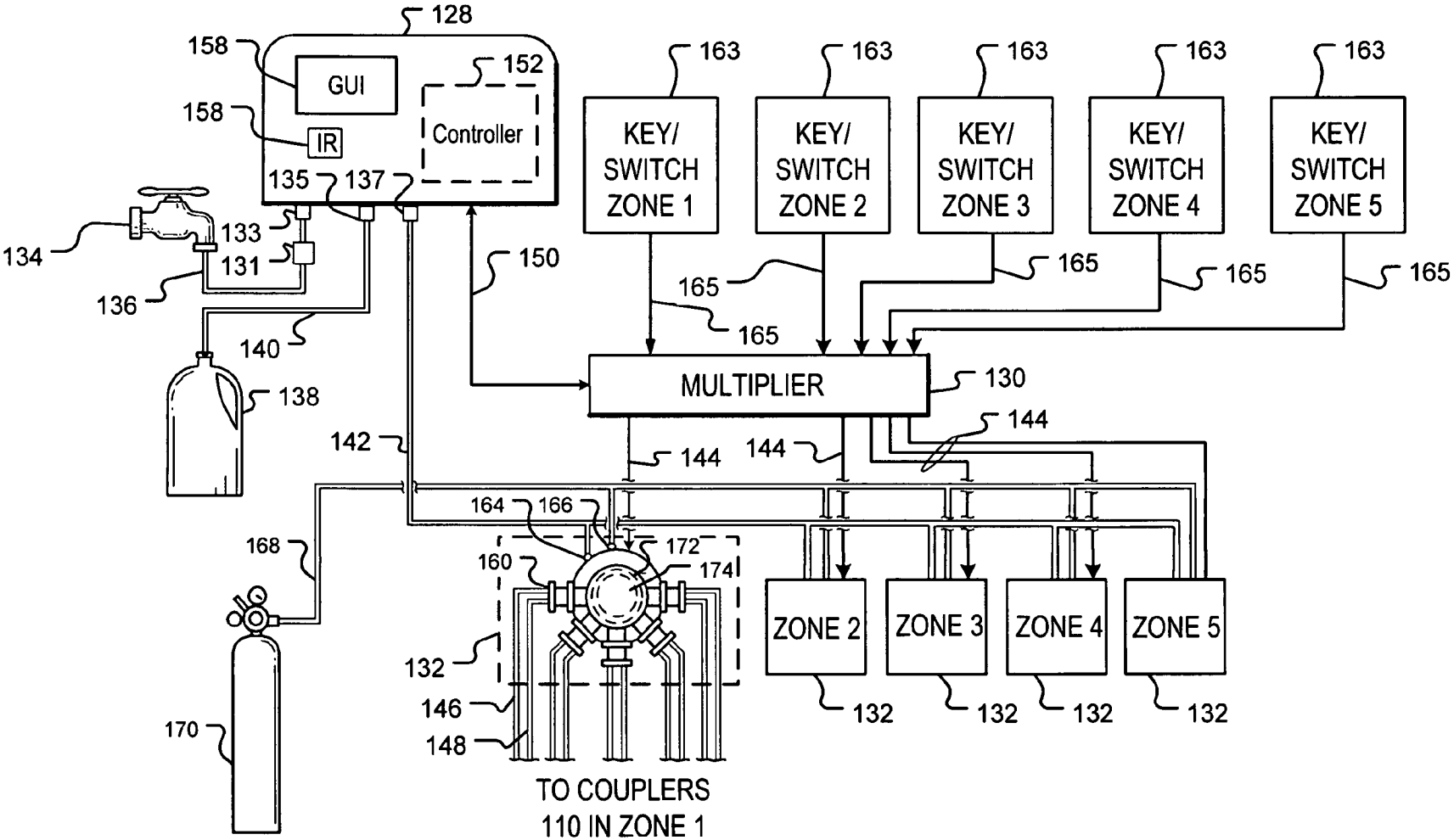
FIG. 2 illustrates in more detail components of the controller-based chemical dispense system shown in FIG. 1 in accordance with an embodiment of the present invention.
Figure 3:
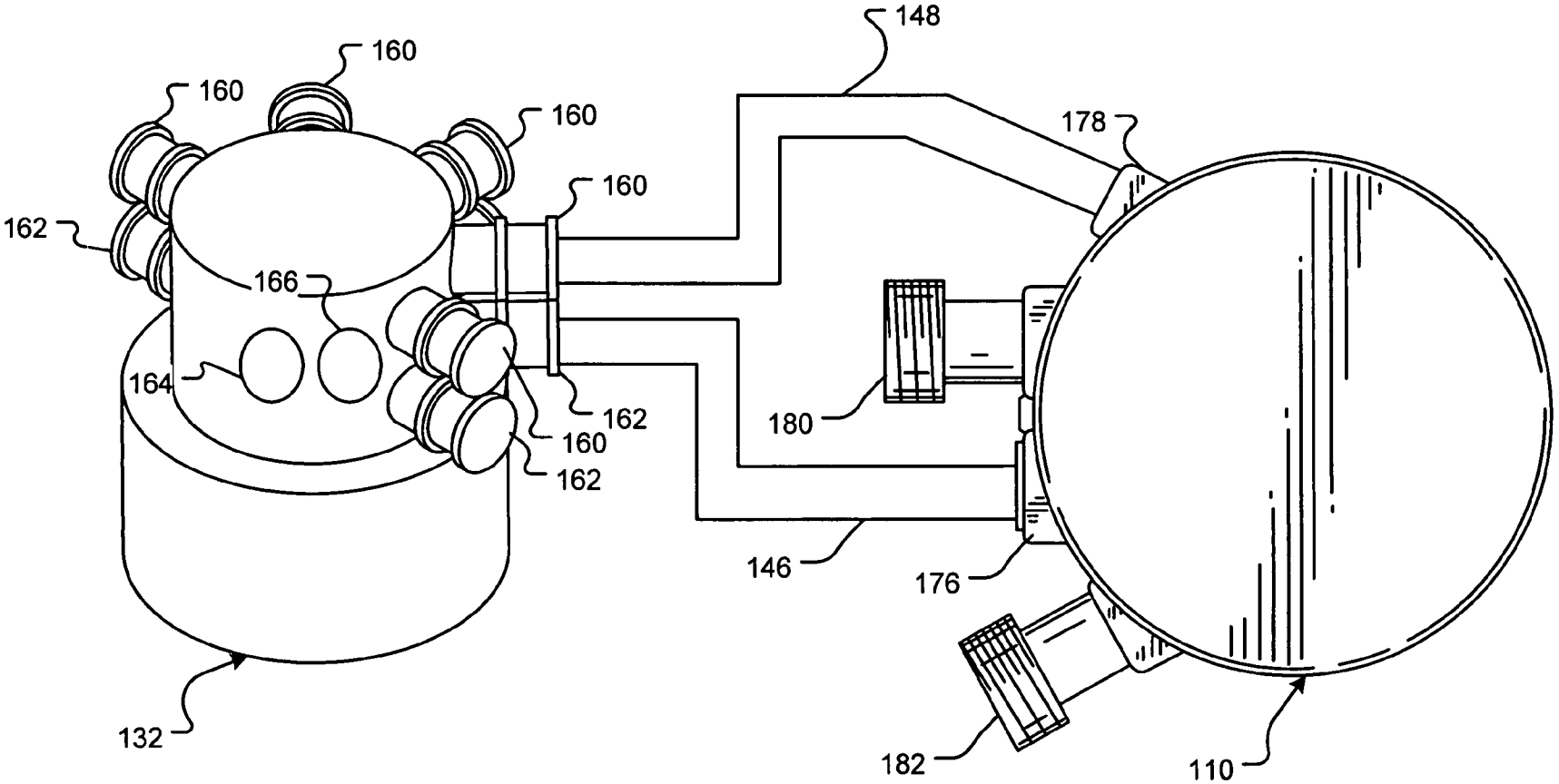
FIG. 3 illustrates a gas-fluid junction and a coupling, and an exemplary connection therebetween for use in the controller-based chemical dispense system shown in FIGS. 1 and 2.
Figure 4:
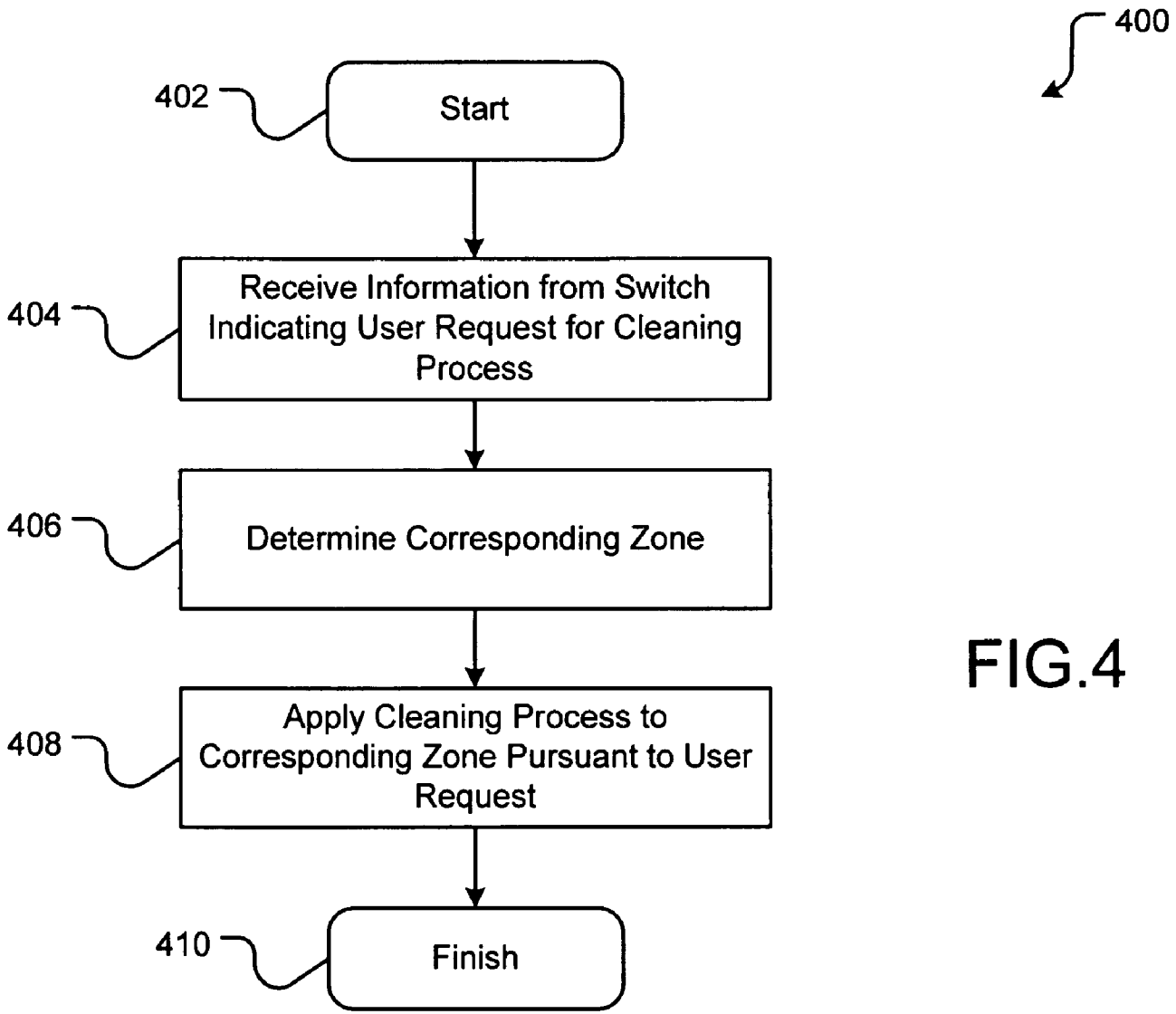
FIG. 4 is a flow diagram that illustrates operational characteristics for administering application of a cleaning process to a fluid dispensing system in accordance with an embodiment of the present invention.

Referring now collectively to FIGS. 2-4, components of the cleaning system are illustrated in greater detail in relation to administration of a cleaning process in accordance with an embodiment of the present invention. The cleaning process is generally defined as being a process during which beverage-carrying components of the beverage dispensing system 100 are cleaned by water and/or a chemical solution. Exemplary beverage-carrying components shown in FIG. 1 include the couplers 110, the beverage lines 108 and the dispensing units 102.

To illustrate embodiments of the present invention, the cleaning process is described as having a washing phase and a cleaning phase. During the washing phase, the cleaning system applies water to the beverage dispensing system 100 to force out any beverage residing in the beverage-carrying components during the initiation of the cleaning process. The cleaning phase is preferably administered at the conclusion of the wash phase and entails the application of at least one chemical solution to clean the beverage-carrying components. It should be appreciated, however, that the sole application of water or a chemical solution without the other is contemplated within the scope of the present invention. As such, the cleaning process may include only the washing phase or the cleaning phase.

Operations of the dispensing control system 128 are controlled by a controller 152 (internal to the control box 128) that controls and monitors various tasks administered by the dispensing control system 128 in performance of cleaning processes. For example, without limitation, the controller 152 controls any pumps, regulators or the like used to pull water and chemical solutions from the water source 134 and the solution container 138, respectively, as well as any pumps, regulators or the like used to enable the flow of water and chemical solutions to the fluid manifold 142. Additionally, the controller 152 may be programmed to communicate with a sensor (not shown) in any one of the beverage lines 108 or in the dispensing units 102 to detect the presence, type and volume of fluids that pass therethrough. For example, the sensor may be a flow meter that detects (via PH or conductivity analyses) whether a certain fluid in a beverage line 108 is a chemical solution or beverage. Furthermore, the sensor may be a flow meter positioned in a dispensing unit 202 that detects the flow and volume of fluids (e.g., beverages, water, chemical solution) out of the unit 102. The controller 152 also monitors and manages operation of the multiplier 130, as addressed in more detail below. In accordance with an embodiment, the controller 152 is a PLC (programmable logic controller) providing hardened I/O (inputs/outputs) for the dispensing control system 128.

As shown in FIG. 2, the dispensing control system 128 may also include one or more display devices or modules, such as, without limitation, a graphical user interface (GUI) 158. The GUI 158 allows a user to monitor and control operation of the dispensing control system 128 through a touch screen interface. For instance, the GUI 158 may present icons to a user that represent the different phases of operation of the cleaning process, including warnings and instructions associated with same. Furthermore, the GUI 158 may present to the user a user a selection screen that enables the user to control aspects of the cleaning process by defining or modifying the phases of the cleaning process (e.g., whether the cleaning process is to have a washing phase, a cleaning phase, or both) or the amount of time that each phase is to be administered. In addition, the GUI 158 may function as an security mechanism for limiting access to the dispensing control system 128 to authorized users.

Alternatively, users may interact with the controller 152 by way of an external computer source, such as a handheld device, which may be wireless or wire-based. To effectuate the wireless handheld devices, the dispensing control system 128 includes an infrared port 129 for communicating data to and from these devices.

In accordance with an embodiment, the multiplier 130 is a stand-alone component of the cleaning system. As such, the multiplier 130 may be either an integrated circuit (IC) operable to receive and transmit signals for purposes of selecting the gas-fluid junctions 132 for activation, as described below, or a controller (e.g., PLC) programmed to receive and transmit data for these same purposes. In an alternative embodiment, the multiplier 130 may be a module integrated with the controller 152, and thus, contained within the housing of the dispensing control system 128.

Regardless of the implementation, the multiplier 130 controls activation of each of the gas-fluid junctions 132 in order to initiate a cleaning process for cleaning the beverage-carrying components within the zone corresponding to the activated gas-fluid junction 132. Selection of a specific gas-fluid junction 132 for activation is based on activation of one of a plurality of switches 163 that are communicatively connected to the multiplier 130 by communication lines 165. The switches 163, which in an embodiment are co-located in the bar area with the dispensing units 102, are activated by user interaction.

For example, one embodiment contemplated within the scope of the present invention is involves the use of a key 800 and a socket 802 to implement the switch 163. An exemplary illustration of this embodiment is provided in FIG. 8. In this exemplary illustration, the key 800 includes a permanent magnet and the socket 802 includes a magneto-reactive element, such as a Hall-sensor. The socket 802 also includes an optical status indicator 804, which may be configured to exhibit behavior (e.g., changes in color, blinking, etc.) that optically indicates to users various phases of a cleaning process in accordance with an embodiment of the present invention, as described in greater detail below in connection with FIGS. 4-7.

The actual structure of the key-socket pair and an exemplary implementation of this key-socket pair as a switch to activate a process for cleaning a beverage system is taught in PCT application Ser. No. EP-0403370, filed Mar. 31, 2004 and assigned to the assignee of interest to the present application. The teachings of this foreign application, which is hereby incorporated by reference in its entirety, provides sufficient detail for implementing the switches 163 in accordance with this embodiment.

Each switch 163 corresponds to a gas-fluid junction 132, and thus, to a specific zone within the beverage dispensing system 100. Activation of a switch 163 generates an electrical current that is provided to the multiplier 130 by the communication line 165 associated with that switch 163. In receipt of the generated current, the multiplier 130 issues notification to the controller 152 over the communication line 150 that a user has activated a particular switch 163, thereby requesting administration of a cleaning process to all beverage-carrying components located in the associated zone. The multiplier 130 then awaits authorization from the controller 152 to initiate the cleaning process. Such authorization comes in the form of data transmitted over the communication line 150. In receipt of this authorization, the multiplier 130 generates a control current that is transmitted to the associated gas-fluid junction 132, thereby triggering initiation of the cleaning process, as described in greater detail below.

The gas-fluid junctions 132 each include a fluid input port 164 and a gas input port 166. The fluid input port 164 is coupled to the fluid manifold 142 and thus accepts fluids (e.g., water and/or chemical solution) therefrom. The gas input port 166 is coupled to a control pressure line 168, which is coupled to a pressure source, such as the gas tank 170. It should be appreciated that the pressure source 170 may alternatively be replaced by either of the pressure sources 116 and 118 shown in FIG. 1 or by the blender 124. The gas-fluid junctions 132 also include a plurality of gas output ports 160 and a plurality of fluid output ports 162. Each of the plurality of gas output ports 160 are paired with one of the plurality of fluid output ports 162. A gas control valve 172, represented using dashed lines, is situated internal to the gas-fluid junction 132 in order to fluidly connect the gas input port 166 to the plurality of gas output ports 160 such that control gas is operable to flow therebetween. Likewise, a fluid control valve 174, represented using dashed lines, is situated internal to the gas-fluid junction 132 in order to fluidly connect the fluid input port 164 to the plurality of fluid output ports 162 such that fluids (e.g., water and/or chemical solution) are operable to flow therebetween.

The gas control valve 172 and the fluid control valve 174 are controlled by the low voltage line 144 input to the gas-fluid junction 132 from the multiplier 130. In response to receiving a current over a low voltage line 144, the gas control valve 172 and the fluid control valve 174 open to enable communication of control gas and fluids (e.g., water and/or chemical solution), respectively, to each of the couplers 110 served by the gas-fluid junction 132. With reference to the illustration in FIG. 3, each fluid output port 162 on the gas-fluid junction 132 is coupled to a fluid input port 176 on a coupler 110 via a junction-coupler fluid line 146 such that fluids (e.g., water and/or chemical solution) may flow therebetween. Likewise, each gas fluid output port 160 on the gas-fluid junction 132 is coupled to a gas input port 178 on a coupler 110 via a junction-coupler gas line 148 such that the control gas may flow therebetween.

In accordance with an embodiment, the coupler 110 may be operated in a beverage dispensing mode or a cleaning mode. In the beverage-dispensing mode, pressure is provided to the coupler 110 via a dispensing pressure port 182 in order to force a beverage contained in the associated beverage container 104 out a beverage line port 180 to a beverage line 108. The beverage line 108 then supplies the beverage to a dispensing unit 102, as described above in connection with FIG. 1.

The coupler 110 enters the cleaning mode in receipt of control gas supplied by the junction-coupler gas line 148. In the cleaning mode, the coupler directs the fluids (e.g., water and/or chemical solution) dispensed from the dispensing control system 128 to the associated beverage line 108 via the beverage port 180. Also, in the cleaning mode, the connection between the coupler 110 and the beverage port 114 on the associated beverage container 104 is closed, thereby precluding the flow of beverage into or out of the container 104. Also, the dispensing pressure port 182 is closed such that fluids (e.g., water and/or chemical solution) are not provided thereto.

The preceding descriptions in connection with FIGS. 1-3 have provided a structural depiction of various embodiments of the present invention in context of a process for cleaning the beverage dispensing system 100. With these embodiments in mind, the remainder of this Detailed Description and the associated drawings are focused on illustrating logical operations performed by the dispensing control system 128 to initiate and manage performance of this cleaning process. Its should be appreciated that these logical operations may be performed either by the controller 152 or by the controller 152 in combination with the multiplier 130.

Referring now to FIG. 4, a process 400 for administering (hereinafter, "administration process") a cleaning process is shown in accordance with an embodiment of the present invention. In this embodiment, the cleaning process includes a plurality of phases that may be selected by a user to customize the cleaning process to his/her liking. These phases include, but are not limited to, a beverage conservation phase, a beverage lockout phase and a cleaning phase, each of which are described in greater detail in connection with FIG. 5 (beverage conservation phase), FIG. 6 (beverage lockout phase) and FIG. 7 (cleaning phase). Indeed, the use may select for the administration process 400 to perform one, two or all three of these phases in accordance with the embodiments described herein.

This administration process 400 is performed using an operation flow that begins with a start operation 402 and concludes with a terminate operation 410. The start operation 402 is initiated in response to a user activating one of the plurality of switches 163 and thereby requesting activation of the cleaning system to clean the beverage dispensing system 100. From the start operation 402, the operation flow proceeds to a reception operation 404.

The reception operation 404 receives the user input from the activated switch 163 and passes the operation flow to an analysis operation 406. The analysis operation 406 determines the zone, and more particularly, the gas-fluid junction 132, associated with the activated switch 163. After the corresponding gas-fluid junction 132 is determined, the operation flow passes to application operation 408.

The application operation 408 applies a cleaning process to the zone associated with the activated switch 163 by commanding the appropriate gas-fluid junction 132 to supply control gas and fluids to each of the couplers 110 served by the junction 132. In accordance with an embodiment of the present invention, the cleaning process applied by the application operation 408 is customized to include only those phases requested by the user input. To accomplish this, the application operation 408 is a dynamic operation that receives user input and, based on this user input, applies the appropriate phases of the cleaning process to the beverage dispensing system 100. Following performance of the application operation 408, the operation flow concludes at the terminate operation 410.

Figure 5:
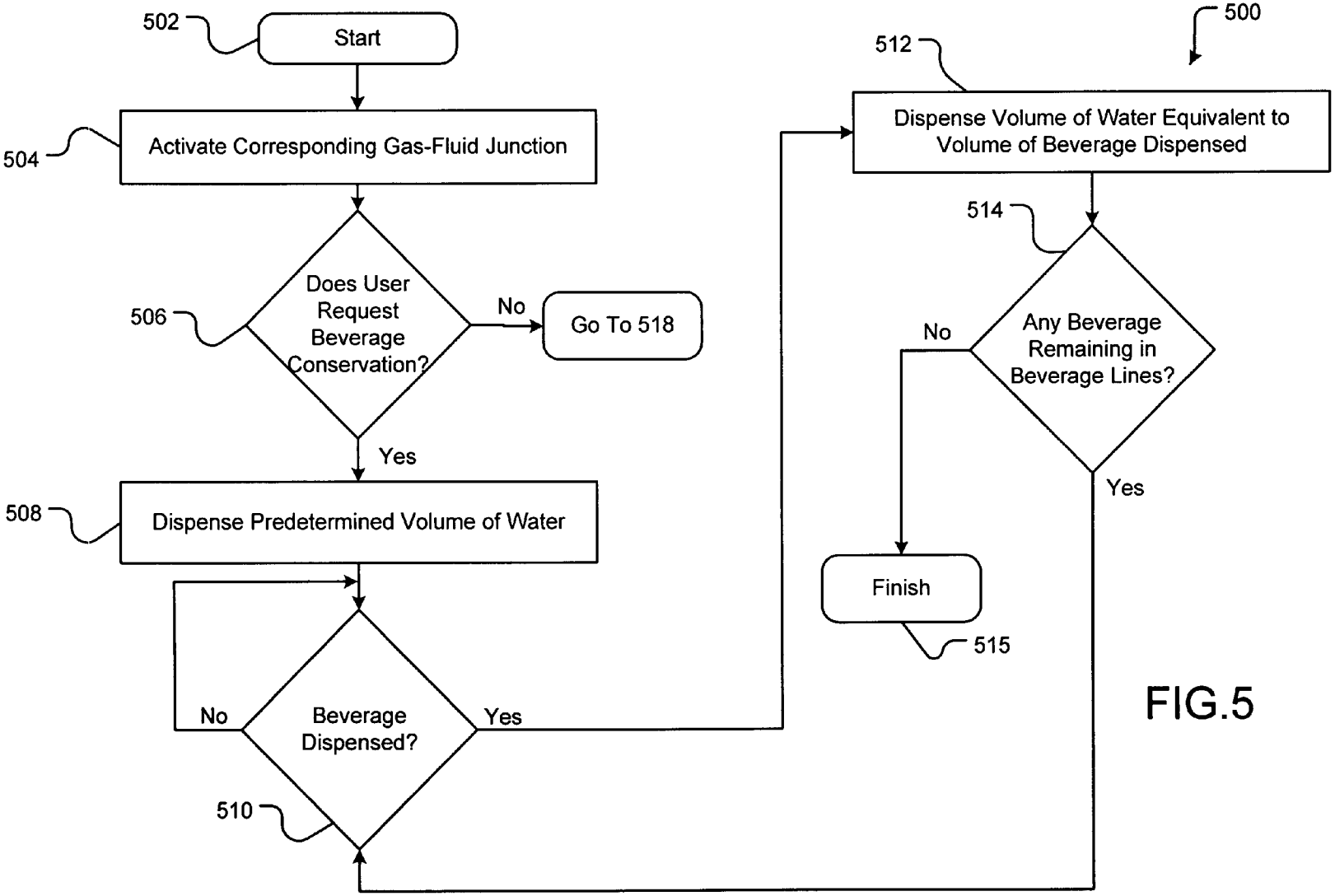
FIGS. 5-7 are flow diagrams that illustrate operational characteristics shown in FIG. 4 in more detail in accordance with an embodiment of the present invention.
Figure 6:
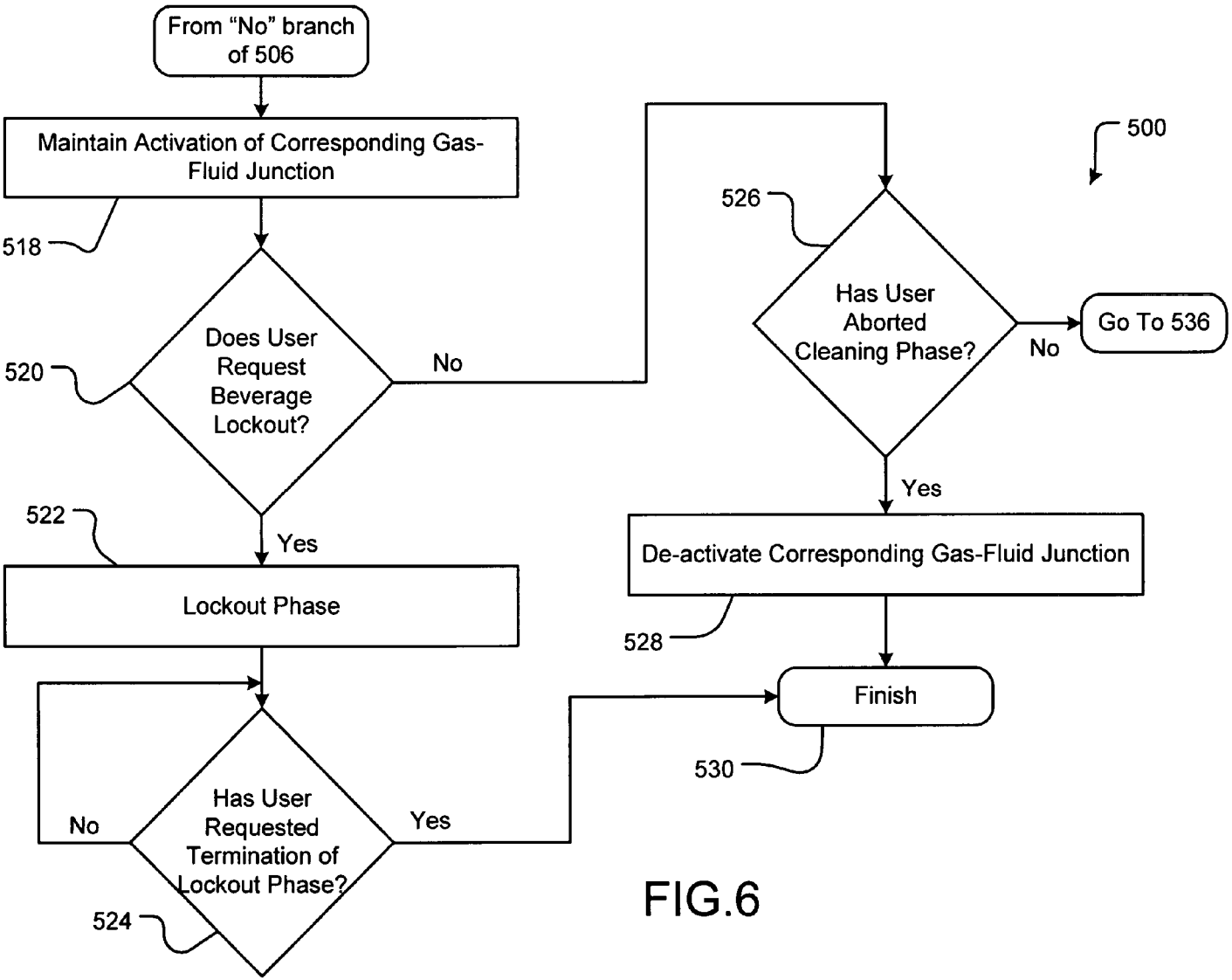
Figure 7:
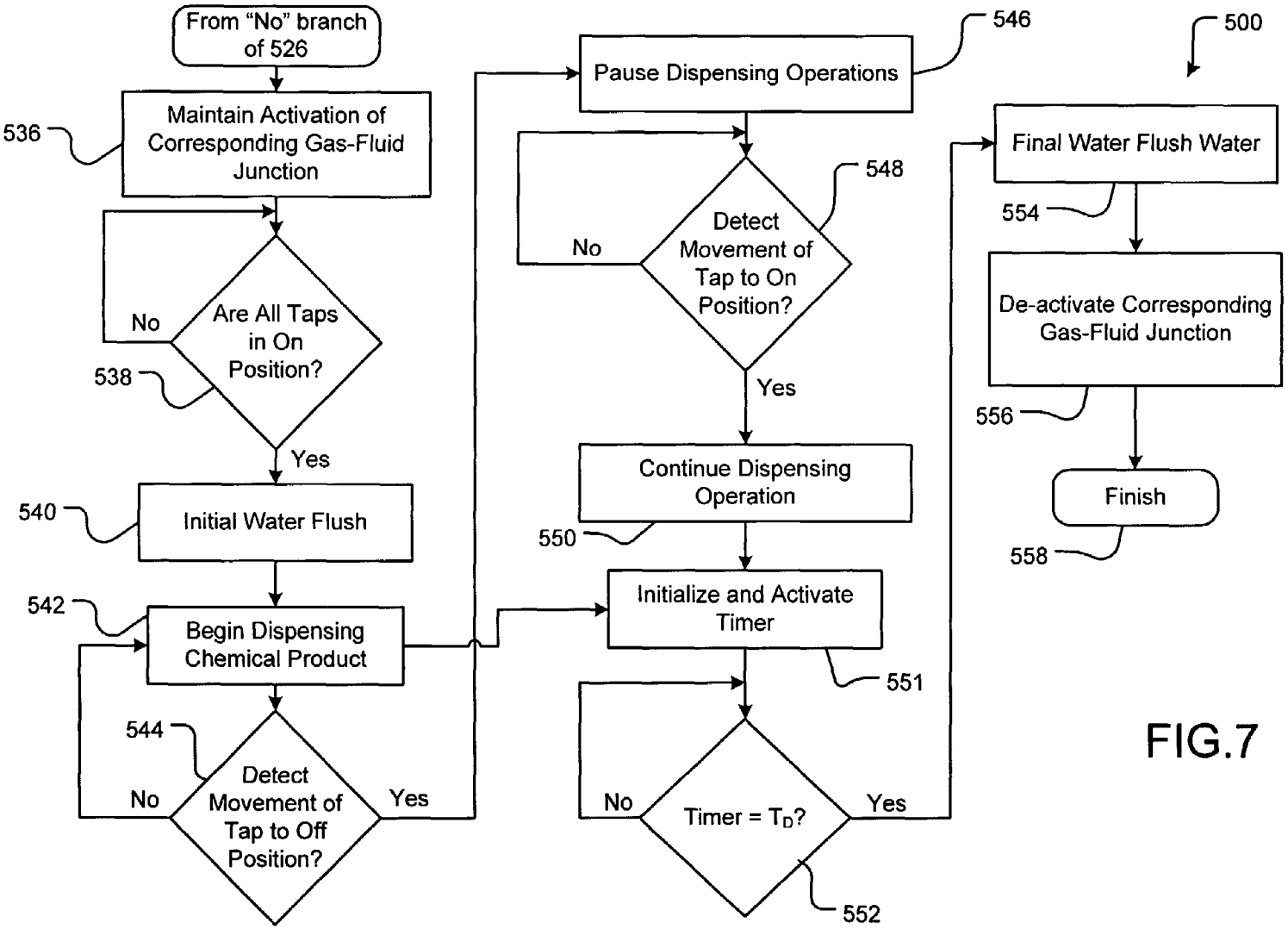

FIGS. 5-7 illustrate in greater detail operational characteristics of the application operation 408 in accordance with embodiments of the present invention. In particular, FIGS. 5-7 collectively illustrate a process 500 (hereinafter, "application process") for applying a cleaning process to a beverage dispensing system 100 in accordance with user selection of phases that are to be performed in the cleaning process. Starting with FIG. 5, the application process 500 is performed using an operation flow beginning with start operation 502 that is initiated following completion of the analysis operation 406. The operation flow shown in FIG. 5 embodies the beverage conservation phase in which a predetermined volume of water is used to push any beverage remaining in the beverage lines 108 to the dispensing units 102 for distribution to users. As such, the beverage remaining in the lines 108 at the initiation of the application process 500 is not wasted, but rather conserved for use.

From the start operation 502, the operation flow passes to a supply operation 504. The supply operation 504 activates the appropriate gas-fluid junction 132 thereby supplying control gas to each of the couplers 110 served by the gas-fluid junction 132. As described above, activation of the appropriate gas-fluid junction 132 may be accomplished the controller 152 directing the multiplier 130 to transmit a control current over a low voltage line 144 to the junction 132. Alternatively, the controller 152 may administer this action by issuing the control current directly to the gas-fluid junction 132. From the supply operation 504, the operation flow passes to a first query operation 506.

The first query operation 506 determines whether the user that activated the switch 163 has requested that the cleaning system enter a beverage conservation phase. In accordance with an embodiment, such a request is input to the dispensing control system 128 by activating the switch 163 and then, after a predetermined period in time, de-activating the switch 163. If the switch 163 is implemented as the key-socket pair illustrated in FIG. 8, the optical status indicator 804 can be used to guide the user through the process of customizing the cleaning process by selecting specific phases for application. For example, insertion of the key 800 into the socket 802 may cause the optical status indicator 804 to change in either appearance (e.g., color) or behavior (e.g., blinking or static). Subsequently, and within the predetermined period of time, if the key 800 is removed from the socket 802, the optical status indicator 804 may change in either appearance or behavior to indicate that the key 800 has been withdrawn in the predetermined period in time and that the beverage conservation phase will soon begin.

For illustrative purposes only, and not by means of limitation, the optical status indicator 804 is statically (i.e., non-blinking) displayed in a first color (e.g., green) prior to insertion of the key 800 into the socket 802. According to this exemplary embodiment, insertion of the key 800 into the socket 802 while the optical status indicator 804 is in the first color transforms the optical status indicator 804 into a flash mode wherein the indicator 804 begins flashing in the first color (e.g., green) thereby indicating to the user that he/she has a predetermined period of time in which to select the conservation phase by withdrawing the key 800 from the socket 902. If the user fails to withdraw the key 800 from the socket 802 within this predetermined period in time, the optical status indicator 804 continues to flash in the first color, however, withdrawal of the key 800 from the socket 802 will result in the cleaning process proceeding to the beverage lockout phase, as described in greater detail in connection with FIG. 6.

If the first query operation 506 determines that the user has requested performance of the beverage conservation phase, the operation flow passes to a first dispense operation 508. Otherwise, the operation flow passes to maintenance operation 518, described below with reference to FIG. 6. The first dispense operation 508 dispenses a predetermined volume of water through the fluid manifold 142 and therefore to each of the gas-fluid junctions 132 in the cleaning system. Because the gas-fluid junction 132 corresponding to the activated switch 132 has been activated, the predetermined volume of water is pushed through this junction 132 and to the couplers 110 in the zone served by the junction 132. From the couplers 110, the water is provided to the associated beverage lines 108 for transport to the dispensing units 102. The predetermined volume of water is determined based on the length of the fluid manifold 142, the junction-coupler fluid lines 146 and the beverage lines 108. After the predetermined volume of water has been dispensed, the operation flow passes to a second query operation 510.

The second query operation 510 determines whether any of the dispensing units 102 have dispensed any volume of beverage, and if so passes the operation flow to the second dispense operation 512. Otherwise, the operation flow remains in a loop and repetitively performs the second query operation 510 until such dispensing occurs. The second dispense operation 512 determines the volume of beverage dispensed and thereafter dispenses a volume of water equivalent to the dispensed volume. The determination of the volume of beverage dispensed may be made any number of ways. For example, a flow meter may be affixed to the output of each dispensing unit 102 to detect the dispensing of beverage therefrom as well as measure the volume of any beverage dispensed therefrom. Then, analyzing the measurements from the flow meter against known measurements, such as the length and cross sectional area of the beverage lines 108, the amount of beverage dispensed may be determined. From the second dispense operation 512, the operation flow passes to a third query operation 514.

The third query operation 514 determines whether any beverage remains in the beverage lines 108 following the dispensing of the determined volume from above. If beverage does indeed remain, the operation flow passes back to the second query operation 510 and continues as previously described. Otherwise, the operation flow concludes at a terminate operation 515 with the beverage conservation completed. As such, in order to re-initiate the cleaning process to move on to the subsequent phases of the cleaning process, an embodiment of the present invention involves initiating the application process 500 at the start operation 502 and repeating the first query operation 506 without requesting performance of the beverage conservation phase. An alternative embodiment contemplated within the scope of the present invention involves passing the operation flow of the application process 500 from the "no" branch of the third query operation 514 directly to the maintenance operation 518 such that the user may re-initiate the cleaning process without pass back through the start operation 502.

Referring now to FIG. 6, the maintenance operation 518 maintains activation the appropriate gas-fluid junction 132 initiated in supply operation 504. From the maintenance operation 518, the operation flow passes to a fourth query operation 520. The fourth query operation 520 determines whether the user that activated the switch 163 has requested that the cleaning process enter a beverage lockout phase wherein the couplers 110 preclude the flow of beverages from the beverage containers 104, thereby shutting off the dispensing units 102 regardless of the position of the handle 103.

As noted in connection with FIG. 5, the operation flow of the application process 500 passed to the maintenance operation 518 with the switch 163 still activated, and thus, the beverage conservation phases passed over. To that end, a user's request for the cleaning process to enter the beverage lockout phase involves by de-activating the switch 163 anytime following the predetermined period in time but prior to the user opening the dispensing units 102 for cleaning (e.g., by moving the handles 103 to the "on" position 103").

Figure 8:
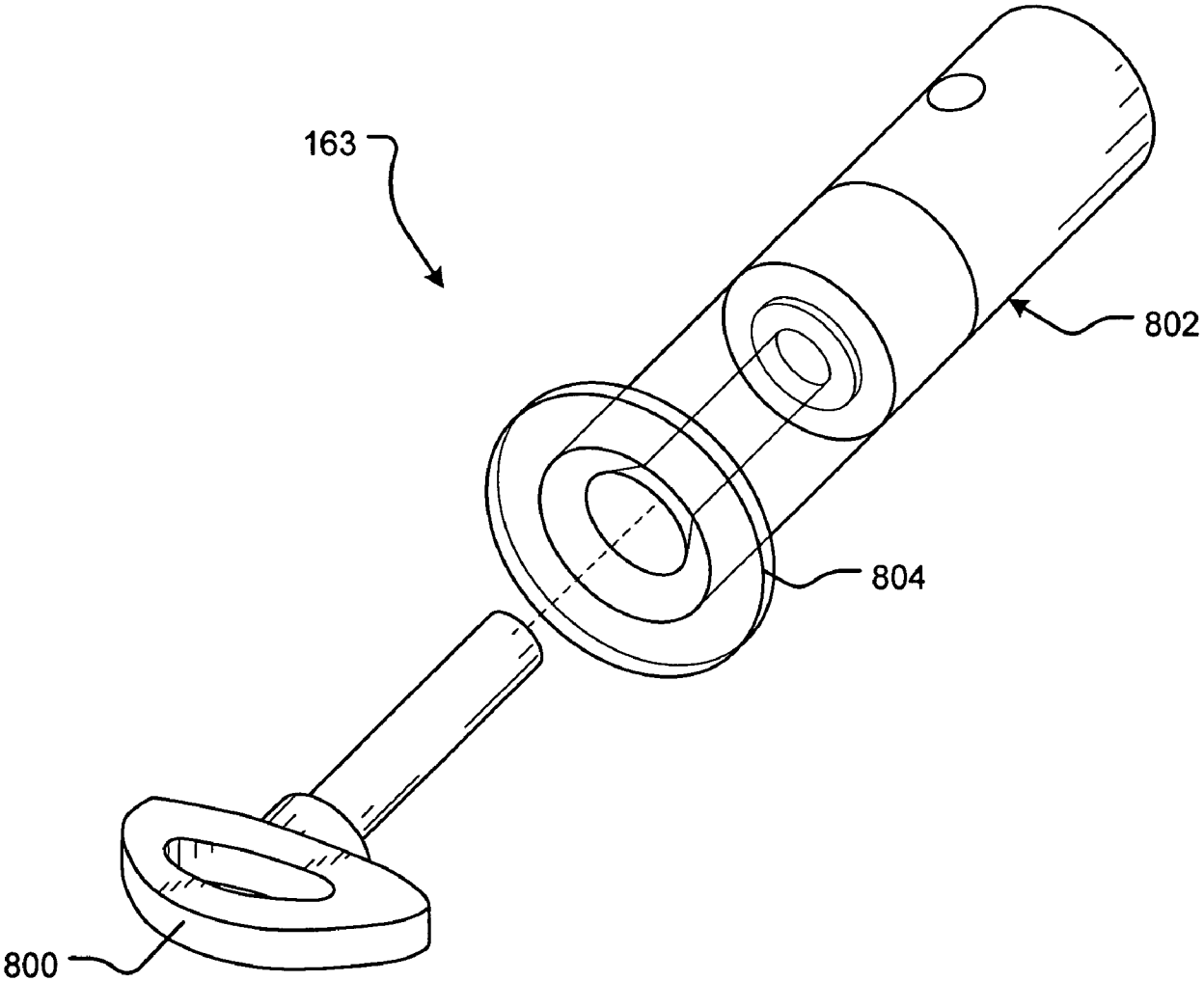
FIG. 8 depicts a switch for use by a user to request performance of a cleaning process in accordance with an exemplary embodiment of the present invention.

Referring back to the exemplary embodiment of the switch 163 being implemented as the key-socket pair illustrated in FIG. 8, the optical status indicator 804 is flashing in the first color due to the maintenance of key insertion in the socket 802 after the predetermined period in time. By removing the key 800 from the socket 802 prior to opening all of the dispensing units for cleaning (e.g., by moving the handles 103 to the "on" position 103"), the user can request to enter the beverage lockout phase. In response to such removal, the optical status indicator 804 stops flashing and changes to a second color (e.g., red), thereby indicating to the user that the cleaning process has entered the beverage lockout phase. If the user does not remove the key 800 from the socket 802, the optical status indicator 804 maintains the flashing mode in the first color until either the user removes the key 800 or opens all of the dispensing units for cleaning (e.g., by moving the handles 103 to the "on" position 103").

If the fourth query operation 520 determines that the user has requested the beverage lockout phase, the operation flow passes to a lockout operation 522. Otherwise, the operation flow passes to a fifth query operation 526, which is described below. The lockout operation 522 maintains the supply of the control gas to each of the couplers 110 in the zone being locked out (i.e., the couplers 110 served by the gas-fluid junction activated by supply operation 504). From the lockout operation 522, the operation flow passes to a sixth query operation 524. The sixth query operation 524 detects whether the user requests termination of the beverage lockout phase and, if so detected, passes the operation flow to a terminate operation 530. Otherwise, the operation flow remains in a loop and repetitively performs the fifth query operation 526 until such a detection occurs. In an embodiment, a request to terminate the beverage lockout phase involves activation of the switch 163, which in the exemplary embodiment described above entails re-insertion of the key 800 into the socket 802.

In order to re-initiate the cleaning process (i.e., move on to the cleaning phase) after completion of the beverage lockout phase, an embodiment of the present invention involves initiating the application process 500 at the start operation 502 and repeating the first query operation 506 without requesting performance of the beverage conservation phase or the beverage lockout phase. An alternative embodiment contemplated within the scope of the present invention involves passing the operation flow of the application process 500 from the "yes" branch of the sixth query operation 524 directly to the fifth query operation 526 such that the user may re-initiate the cleaning process without pass back through the start operation 502.

If the operation flow has passed to the fifth query operation 524 from the fourth query operation 420, then the user has opened all of the dispensing units for cleaning (e.g., by moving the handles 103 to the "on" position 103") prior to activating the switch 163. As such, the user has indirectly requested performance of the cleaning phase. To be sure, however, the fifth query operation 524 determines whether the user has decided to abort the cleaning phase by de-activating the switch 163 even after all dispensing units 102 have been opened for cleaning (e.g., by moving the handles 103 to the "on" position 103").

As noted in the exemplary key-socket embodiment described above, de-activating the switch 163 to abort the cleaning phase prior to its initiation involves withdrawing the key 800 from the socket 802. If the fifth query operation 524 determines that the user has not aborted the cleaning phase, the operation flow passes to a maintenance operation 536. Otherwise, the operation flow passes to a de-activate operation 528, which de-activates the gas-fluid junction 132 activated by the supply operation 504 such that the control gas and fluid are hereinafter precluded from passing through the gas-fluid junction 132 to the couplers 110 in the zone served by the gas-fluid junction 132. From the de-activate operation 528, the operation flow concludes at the terminate operation 530.

Referring now to FIG. 7, the operation flow of the administration process 500 continues from the "no" branch of the fifth query operation 526 and passes to the maintenance operation 536. The maintenance operation 536 maintains activation the appropriate gas-fluid junction 132 initiated in supply operation 504. From the maintenance operation 518, the operation flow passes to a seventh query operation 538. The seventh query operation 538 is a safety feature that checks to make sure that the handles 103 of all dispensing units 102 in the zone served by the activated gas-fluid junction 132 are in the "on" position 103", thereby ensuring that all fluids (water and/or chemical solutions) dispensed through the associated beverage lines 108 may be dispensed through the dispensing units 102. In accordance with an embodiment, a sensor, such as a flow meter, may be employed to make such a determination.

Regardless of the means by which such a detection may be made, if the seventh query operation 538 detects that any of the handles 103 of the dispensing units 102 in the zone served by the activated gas-fluid junction 132 are in the "off" position 103', the operation flow is maintained in a loop that repetitively passes back to the seventh query operation 538 until it is detected that the handles 103 for each of these dispensing units 102 are indeed "on." Otherwise, the operation flow passes to a third dispense operation 540.

The third dispense operation 540 administers the first of the cleaning phase by dispensing water to the gas-fluid junctions 132. In receipt of this water, the activated gas-fluid junction 132 passes the water to each of the couplers 110 in the zone served by that gas-fluid junction 132 for distribution to the associated beverage lines 108, dispensing units 102 and any other beverage-carrying components of the beverage dispense system 100. The water therefore flushes any particles or remaining beverages from the beverage-carrying components in preparation for subsequent supply of a chemical solution.

After the beverage-carrying components have been flushed by the third dispense operation 540, the operation flow passes to a fourth dispense operation 542. The fourth dispense operation 542 begins applying the chemical solution to the beverage-carrying components in the zone served by the activated gas-fluid junction 132. In a preferred embodiment, a predetermined volume of the chemical solution is dispensed to these components, and while the solution is being dispensed, the operation flow passes to an eighth query operation 544.

The eighth query operation 544, like the seventh query operation 538 is a safety check to detect whether any of the handles 103 of any dispensing unit 102 associated with the activated junction 132 has been moved to the "off" position 103'. If none of these handles 103 have been moved to the "off" position 103', then the operation flow passes back to the fourth dispense operation 542, and then again back to the eighth query operation 544 until (1) either the predetermined volume of chemical solution has been dispensed; or (2) one of the handles 103 has been moved to the "off" position 103'. If (1) happens before (2), i.e., if the predetermined volume of chemical solution is dispensed prior to any one of the handles being moved to the "off" position 103', then the operation flow passes from the fourth dispense operation 542 to an initialize timer operation 551, described below.

However, if (2) happens before (1), i.e., if any one of the handles is moved to the "off" position 103' prior to the predetermined volume of chemical solution being dispensed, then the operation flow passes to a pause operation 546, which pauses the dispensing of the chemical solution to the beverage-carrying components. From the pause operation 546, the operation flow passes to a ninth query operation 548. The ninth query operation detects whether the handle 103 that had been moved to the "off" position 103', as detected by the eighth query operation 544 has been moved back to the "off" position 103". If so, the operation flow passes to a continue operation 550, which re-initiates dispensing of the chemical solution until the predetermined volume has been dispensed into the beverage-carrying component, at which time, the operation flow is passed to an initialize timer operation 551.

The initialize timer operation 551 initializes and initiates a timer for counting a duration that the beverage-carrying components are soaked in the chemical solution. After the clock has been initialized and initiated, the operation flow passes a timer test operation 552. The timer test operation 552 compares the count of the clock against a predetermined length in time set by a user to be the duration of the soaking phase. If the clock count is equal to or greater than this predetermined duration, then the operation flow passes to a fifth dispense operation 554. Otherwise, the operation flow remains in loop passing back to the timer test operation 552 until the predetermined duration is met.

The fifth dispense operation 554 dispenses water to all of the beverage-carrying components in the zone served by the activated gas-fluid junction such that all chemical solution dispensed thereto is washed out of these components. From the fifth dispense operation 554, the operation flows to a deactivate operation 554. The de-activate operation 556 de-activates the gas-fluid junction 132 activated by the supply operation 504 such that the control gas and fluid are hereinafter precluded from passing through the junction 132 to the couplers 110 served by the junction 132. From the de-activate operation 556, the operation flow concludes at the terminate operation 558.

Having described the embodiments of the present invention with reference to the figures above, it should be appreciated that numerous modifications may be made to the present invention that will readily suggest themselves to those skilled in the art and which are encompassed in the spirit of the invention disclosed and as defined in the appended claims. Indeed, while a presently preferred embodiment has been described for purposes of this disclosure, various changes and modifications may be made which are well within the scope of the present invention. For example, the water and chemical compounds provided to the junctions 132, the couplers 110, the beverage containers 104 and the dispensing units 102 by the dispensing control system 128 may be replaced or supplemented with air. Like the fluids, application of such air is controlled by the controller 152 and multiplier 130 in order to clean out the various beverage-carrying components of the present invention.

Additionally, the various electrical connections described herein (e.g., the low voltage lines 144, the communication lines 165 and the communication line 150) are illustrated as being wire-based electrical connections. It should be appreciated, however, that any of these electrical connections may alternatively be effectuated by wireless communications. Furthermore, while the cleaning process of the present invention is described in an exemplary embodiment as being applied to the beverage dispensing system 100 to "clean" the various beverage-carrying components thereof, it is contemplated within the scope of the present invention that the cleaning system may also be employed to sanitize these components. To that end, the chemical products dispensed by the dispensing controller 128 should not be limited to cleaning products, such as detergents, soaps, etc., but these products may also include sanitizing agents.

Moreover, while the eighth query operation 544 and the seventh query operation 538 are described as determining whether any one of the handles 103 of any dispensing unit 102 associated with the activated junction 132 are in the "off" position 103', these operations may alternatively query whether all of the handles 103 of any dispensing unit 102 associated with the activated junction 132 are in the "off" position 103'. In this alternative embodiment, if any one of these handles 103 is not in the "off" position 103', and thus in the "on" position 103" then the operation flow braches "yes" from the seventh query operation 538 and "no" from the eighth query operation 544. As such, the cleaning phase may be initiated and administered in this alternative embodiment even without the cleaning phase directing fluids (e.g., water and/or chemical solution) through all dispensing units in the zone controlled by the activated junction 132. In accordance with even a further embodiment, detection by the controller 128 that a particular dispensing unit 102 is not operable to dispense communicated fluids results in the controller 128 focusing supply of the portion of the fluids intended for supply to the inoperable dispensing unit 102 to the operable dispensing units 102 within that same zone.

In accordance with another embodiment, an alternative supply of a particular beverage may be provided in an alternative beverage dispenser 104 such that if the supply of that beverage from the primary beverage dispenser 104 is exhausted, the beverage may be supplied from the alternative dispenser 104. In these embodiment, a keg switch (not shown) may be used to switch between beverage lines 108 from the primary and alternative beverage containers to thereby provide the particular beverage to a dispensing unit 102 over a shared beverage line 108. The keg switch includes sensors that detect the exhaustion of beverage from the primary beverage container 104 and swap beverage lines 108 such that the beverage is thereafter provided from the alternative beverage container 104. With respect to this implementation, it is preferable according to the present invention to include the primary and alternative beverage containers 104 within the same zone, and thus, fluidly coupled to the same gas-fluid junction 132.

In accordance with yet another embodiment, if a beverage pump is utilized in the beverage line 108, the beverage pump includes an interrupt for shutting down power to the pump while the chemical solution soaks in the beverage-carrying components during the cleaning phase. Such control is administered by the controller 128 in accordance with this embodiment.

Figure 9:
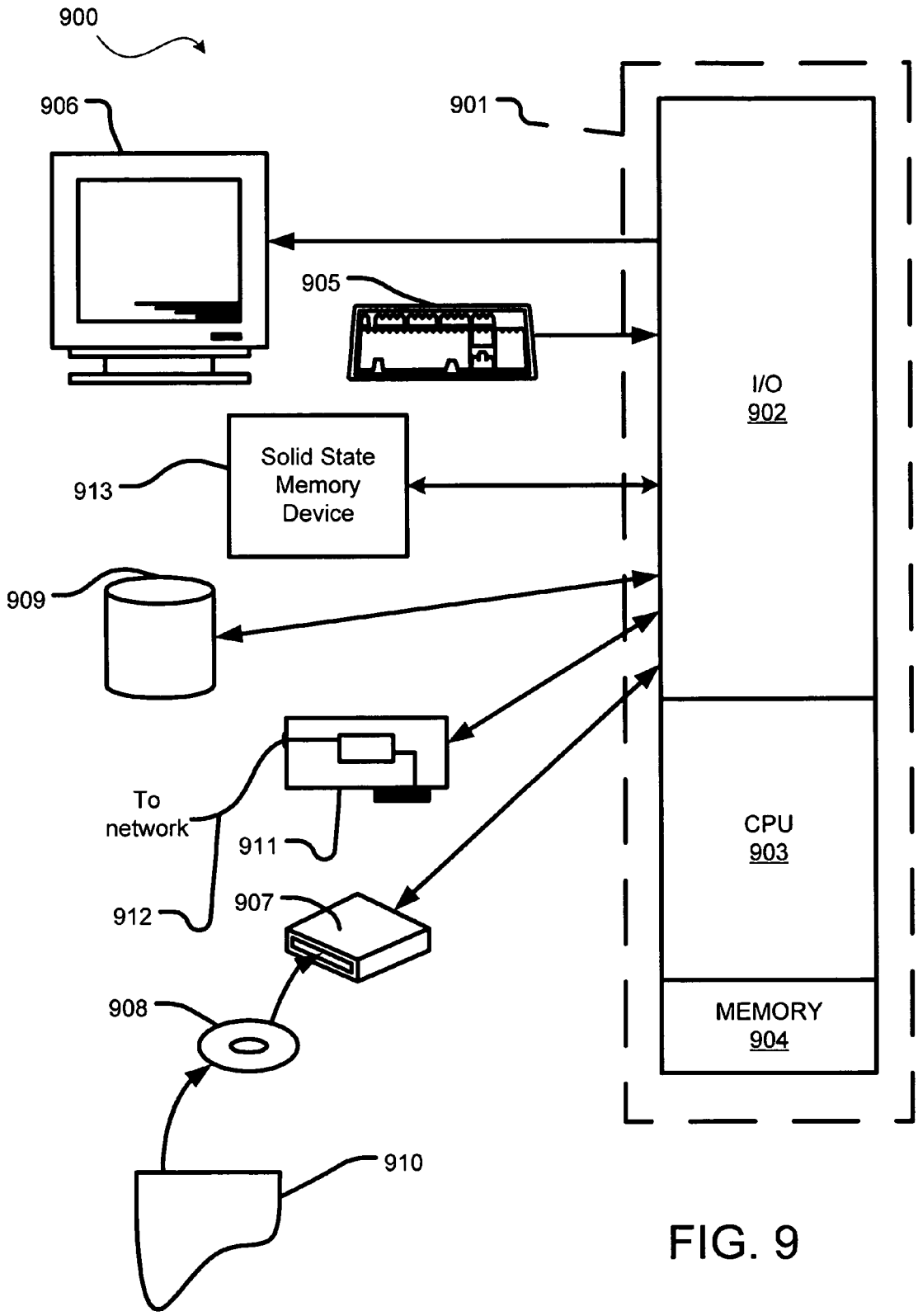
FIG. 9 depicts a general-purpose computer that may be configured to implement logical operations of the present invention in accordance with an embodiment thereof.

In addition, the controller 152 is described herein as conventional electrical and electronic devices/components, such as, without limitation, programmable logic controllers (PLC's) and logic components, but may alternatively be replaced by a processor 901 integrated into a computer readable medium environment as optionally shown in FIG. 9. As such, the logical operations of the present invention described in FIGS. 4-7 may be administered by the processor 901 in this computer readable medium environment. Referring to FIG. 9, such an embodiment is shown by a computing system 900 capable of executing a computer readable medium embodiment of the present invention.

One operating environment in which the present invention is potentially useful encompasses the computing system 900, such as, for example, dispensing control system 128 or a remote computer to which information collected by the dispensing control system 128 may be uploaded. In such a system, data and program files may be input to the computing system 900, which reads the files and executes the programs therein. Some of the elements of a computing system 900 are shown in FIG. 9 wherein a controller (e.g., controller 152), illustrated as a processor 901, is shown having an input/output (I/O) section 902, a microprocessor, or Central Processing Unit (CPU) 903, and a memory section 904. The present invention is optionally implemented in this embodiment in software or firmware modules loaded in memory 904 and/or stored on a solid state, non-volatile memory device 913, a configured CD-ROM 908 or a disk storage unit 909. As such, the computing system 900 is used as a "special-purpose" machine for implementing the present invention.

The I/O section 902 is connected to a user input module 905, e.g., a keyboard, a display unit 906, etc., and one or more program storage devices, such as, without limitation, the solid state, non-volatile memory device 913, the disk storage unit 909, and the disk drive unit 907. The solid state, non-volatile memory device 913 is an embedded memory device for storing instructions and commands in a form readable by the CPU 903. In accordance with various embodiments, the solid state, non-volatile memory device 913 may be Read-Only Memory (ROM), an Erasable Programmable ROM (EPROM), Electrically-Erasable Programmable ROM (EEPROM), a Flash Memory or a Programmable ROM, or any other form of solid state, non-volatile memory. In accordance with this embodiment, the disk drive unit 907 may be a CD-ROM driver unit capable of reading the CD-ROM medium 908, which typically contains programs 910 and data. Alternatively, the disk drive unit 907 may be replaced or supplemented by a floppy drive unit, a tape drive unit, or other storage medium drive unit. Computer readable media containing mechanisms (e.g., instructions, modules) to effectuate the systems and methods in accordance with the present invention may reside in the memory section 904, the solid state, non-volatile memory device 913, the disk storage unit 909 or the CD-ROM medium 908. Further, the computer readable media may be embodied in electrical signals representing data bits causing a transformation or reduction of the electrical signal representation, and the maintenance of data bits at memory locations in the memory 904, the solid state, non-volatile memory device 913, the configured CD-ROM 908 or the storage unit 909 to thereby reconfigure or otherwise alter the operation of the computing system 900, as well as other processing signals. The memory locations where data bits are maintained are physical locations that have particular electrical, magnetic, or optical properties corresponding to the data bits.

In accordance with a computer readable medium embodiment of the present invention, software instructions stored on the solid state, non-volatile memory device 913, the disk storage unit 909, or the CD-ROM 908 are executed by the CPU 903. In this embodiment, these instructions may be directed toward administering application of a cleaning process, customized or non-customized, to a beverage dispensing system. Data used in the analysis of such applications may be stored in memory section 904, or on the solid state, non-volatile memory device 913, the disk storage unit 909, the disk drive unit 907 or other storage medium units coupled to the system 900.

In accordance with one embodiment, the computing system 900 further comprises an operating system and usually one or more application programs. Such an embodiment is familiar to those of ordinary skill in the art. The operating system comprises a set of programs that control operations of the computing system 900 and allocation of resources. The set of programs, inclusive of certain utility programs, also provide a graphical user interface (e.g., GUI 158) to the user. An application program is software that runs on top of the operating system software and uses computer resources made available through the operating system to perform application specific tasks desired by the user. The operating system is operable to multitask, i.e., execute computing tasks in multiple threads, and thus may be any of the following: Microsoft Corporation's "WINDOWS 95," "WINDOWS CE," "WINDOWS 98," "WINDOWS 9000" or "WINDOWS NT" operating systems, IBM's OS/2 WARP, Apple's MACINTOSH OSX operating system, Linux, UNIX, etc.

In accordance with yet another embodiment, the controller 152 connects to a communications network by way of a network interface, such as the network adapter 911 shown in FIG. 9. Through this network connection, the controller 152 is operable to transmit information to one or more remote computers, such as, without limitation, a server computer or user terminals. Various types of information may be transmitted from the controller 152 to these remote computers over the network connection. In addition, the network adaptor 911 enables users at remote computers the ability to issue commands to the controller 152 if so desired.

What is claimed is:

1. A chemical dispense system for cleaning a fluid dispensing system, wherein fluid containers store fluids for dispensing from the fluid dispensing system, each fluid container comprising a coupler for opening a fluid port through which fluid flows through the coupler to a dispensing unit via a fluid line, the system comprising:

a plurality of junctions each operable to communicate water supplied by a water source to at least one coupler such that the couplers may each direct the water to an associated fluid line;

a controller operable to control the supply of water from the water source to each of the plurality of junctions; and a multiplier operable to transmit a control signal to a specified one of the plurality of junctions thereby activating the specified junction to communicate water to an associated coupler when the supply of water to the plurality of junctions is enabled by the controller.

2. A chemical dispense system as defined in claim 1, wherein the controller enables the flow of a predetermined volume of water during activation of the specified junction such that the predetermined volume of water is operable to force a pressure on any fluid remaining in a fluid line fluidly coupled to the associated coupler thereby conserving the remaining fluid for dispensing from a dispensing unit fluidly coupled to the fluid line.

3. A chemical dispense system as defined in claim 1, wherein the controller is operable to control supply of a chemical solution to the plurality of junctions and wherein the specified junction communicates the chemical solution to the associated coupler when the supply of chemical solution to the plurality of junctions is enabled by the controller and the specified junction is activated by the multiplier.

4. A chemical dispense system as defined in claim 3, wherein the controller enables the supply of water and the supply of chemical solution to the plurality of junctions in sequence during activation of the specified junction.

5. A chemical dispense system as defined in claim 1, further comprising:

a user input mechanism operable to receive user input identifying the specified junction and, based on the user input, instruct the multiplier which of the plurality of junctions is the specified junction.

6. A chemical dispense system as defined in claim 5, wherein the user input mechanism comprises a switch.

7. A chemical dispense system as defined in claim 5, wherein the user input mechanism comprises a graphical user interface.

8. A fluid dispense system comprising:

a plurality of dispensing units;

a plurality of fluid containers, wherein each fluid container is associated with and fluidly connected to at least one of the plurality of dispensing units via an associated fluid dispense line, each fluid container comprising a controllable fluid port through which fluid exits the fluid container for communication to the associated fluid dispense line;

a plurality of couplers, wherein each coupler is associated with one of the plurality of fluid containers and fluidly couples the controllable fluid port of the associated fluid container to the associated fluid dispense line, the plurality of couplers being operable to open and close the controllable fluid ports thereby controlling communication of fluids from the fluid containers to the dispensing units via the associated fluid dispense lines, wherein the plurality of couplers are categorized into a plurality of zones, each of the plurality of zones comprising one or more couplers;

a system controller operable to enable supply of a substance to the plurality of couplers; and a zone controller operable to select a specified one of the plurality of zones in order to communicate the substance to the one or more couplers categorized therein when supply of the substance to the plurality of zones is enabled by the system controller, wherein the one or more couplers categorized in the specified zone direct the substance to one or more associated fluid dispense lines for communication to one or more associated dispensing units.

9. A fluid dispense system as defined in claim 8, wherein each of the plurality of zones comprise a controllable junction operable to communicate the substance to the one or more couplers categorized therein when selected as the specified zone by the zone controller.

10. A fluid dispense system as defined in claim 9, wherein the controllable junctions are communicatively coupled to the zone controller via data lines and the zone controller selects the specified zone by issuing a control signal to the controllable junction associated with the specified zone.

11. A fluid dispense system as defined in claim 10, further comprising:

a user input mechanism operable to receive user input identifying the specified zone and, based on the user input, instruct the zone controller which of the plurality of zones is the specified zone.

12. A fluid dispense system as defined in claim 8, wherein the substance comprises water.

13. A fluid dispense system as defined in claim 8, wherein the substance comprises a chemical solution.

14. A fluid dispense system as defined in claim 8, wherein the fluids contained in the plurality of storage containers and dispensed from the plurality of dispensing units via associated fluid dispense lines comprise a beverage.

15. A chemical dispense system for cleaning a fluid dispensing system having fluid containers storing fluids for dispensing to a point of use, wherein each fluid container comprises a coupler for enabling and disabling the flow of fluid from the fluid container to a dispensing unit located at the point of use, the system comprising:

a system controller operable to enable supply of a substance to the couplers on the fluid containers, wherein the couplers are categorized into a plurality of zones, each of the plurality of zones comprising one or more couplers; and a zone controller operable to select a specified one of the plurality of zones in order to communicate the substance to the one or more couplers categorized therein when supply of the substance to the couplers is enabled by the system controller, wherein the one or more couplers categorized in the specified zone direct the substance to one or more associated dispensing units.

16. A chemical dispense system as defined in claim 15, further comprising:

a user input mechanism operable to receive user input identifying the specified zone and, based on the user input, instruct the zone controller which of the plurality of zones is the specified zone.

17. A fluid dispense system as defined in claim 15, wherein each of the plurality of zones comprise a controllable junction operable to communicate the substance to the one or more couplers categorized therein when selected as the specified zone by the zone controller.

18. A fluid dispense system as defined in claim 15, wherein the substance comprises water.

19. A fluid dispense system as defined in claim 15, further comprising:

a data communication link communicatively connecting the system controller to the zone controller such that the system controller is operable to monitor operation of the zone controller.

20. A fluid dispense system as defined in claim 19, wherein the substance comprises a chemical solution, the system controller being further operable to enable supply of water to the couplers on the fluid containers in sequence with the chemical solution based on data received over the data communication link.

* * * * *

UNITED STATES PATENT AND TRADEMARK OFFICE

CERTIFICATE OF CORRECTION

PATENT NO. : 7,311,224 B2
APPLICATION NO. : 10/985302
DATED : December 25, 2007
INVENTOR(S) : Emmendoerfer et al.

It is certified that error appears in the above-identified patent and that said Letters Patent is hereby corrected as shown below:

On Column 15, line 39, “braches”, should read --branches--

Signed and Sealed this

Twenty-fourth Day of June, 2008

JON W. DUDAS
*Director of the United States Patent and Trademark Office*